US005860572A

United States Patent [19]

Harrold et al.

[11] Patent Number: 5,860,572

[45] Date of Patent: Jan. 19, 1999

[54] SIDE ACTION VERTICAL RATCHET DISPENSER WITH REVERSIBLE TRIGGER

[75] Inventors: John E. Harrold, Borough of Bloomsbury; Jack Weinstein, Manchester Township, both of N.J.

[73] Assignee: Primary Delivery Systems, Inc., Easton, Pa.

[21] Appl. No.: 695,864

[22] Filed: Aug. 9, 1996

Related U.S. Application Data

[63] Continuation-in-part of Ser. No. 586,301, Jan. 16, 1996, which is a continuation-in-part of Ser. No. 332,873, Nov. 1, 1994, abandoned, which is a continuation-in-part of Ser. No. 619,008, Mar. 21, 1996, Pat. No. 5,638,151, which is a continuation-in-part of Ser. No. 56,866, May 5, 1993, Pat. No. 5,320,259, which is a continuation-in-part of Ser. No. 490,286, Jun. 14, 1995, Pat. No. 5,570,821.

[51] Int. Cl.[6] ..... B67D 5/42

[52] U.S. Cl. ..... 222/391; 401/181

[58] Field of Search ..... 222/189, 326, 222/327, 386, 391; 401/66, 178, 181; 206/385; 604/209, 210, 224

[56] References Cited

U.S. PATENT DOCUMENTS

| | | | |
|---|---|---|---|
| 2,086,462 | 7/1936 | Bost | 222/391 X |
| 2,872,034 | 2/1959 | Harris | 132/318 X |
| 3,221,409 | 12/1965 | Thiel et al. | 222/391 |
| 3,977,574 | 8/1976 | Thomas | 222/391 |
| 4,318,499 | 3/1982 | Hamilton | 222/391 X |
| 4,323,176 | 4/1982 | Sartain | 222/391 X |
| 5,320,259 | 6/1994 | Weinstein | 222/391 |
| 5,372,285 | 12/1994 | Harrold et al. | 222/391 X |

*Primary Examiner*—Kenneth Bomberg

*Attorney, Agent, or Firm*—Kenneth P. Glynn, Esq.

[57] ABSTRACT

A dispenser has a main hollow housing with side walls, a base and an open top which is at least partially open for dispensing material. A vertical support column is slidably mounted within the housing with horizontal ratchets and a push plate on top. A trigger component within the main hollow housing is movably connected to the housing and to the horizontal ratchets, and has an advancer arm, an opposing retractor arm and a flexible spring. The trigger component acts as a trigger, a ratcheting member and a spring and is strategically positioned in a swingable manner such that it may be rotated inwardly and released outwardly to cause advancement or retraction of the vertical support column.

20 Claims, 7 Drawing Sheets

SIDE ACTION VERTICAL RATCHET DISPENSER WITH REVERSIBLE TRIGGER

REFERENCE TO RELATED APPLICATION

This application is a continuation-in-part of U.S. patent application Ser. No. 08/586,301, filed on Jan. 16, 1996, and entitled "Ramping Vertical Ratchet Dispenser", which is a continuation-in-part of U.S. patent application Ser. No. 08/332,873, filed on Nov. 1, 1994, now abandoned, and entitled "Staged Vertical Ratchet Dispenser Device", which is a continuation-in-part of U.S. pat. appl. Ser. No. 08/619,008, filed Mar. 21, 1996, now U.S. Pat. No. 5,638,151 which is a continuation-in-part U.S. pat. appl. Ser. No. 08/256,866, filed May 5, 1993, U.S. Pat. No. 5,320,259, issued on Jun. 14, 1994, and entitled "Vertical Ratchet Dispenser with Hinged Trigger". The application entitled "Ramping Vertical Ratchet Dispenser", is also a continuation-in-part of U.S. patent application Ser. No. 08/490,286, filed on Jun. 14, 1995, now U.S. Pat. No. 5,570,821, and entitled "Vertical Ratchet Dispenser Device with Anti-oozing Pull-Back Mechanism".

BACKGROUND OF THE INVENTION

1. Field of the Invention

The present invention is directed to dispensers and, specifically to vertical ratchet dispensers which are utilized to advance viscous liquids, creams, pastes, cakes, bars, gels, and the like, to move dispensing material out of the dispenser at rates and times desired by the user. More specifically, the present invention is directed to such dispensers which involve vertical ratcheting by utilization of a unique ratcheting arrangement which functions in combination with a hinged trigger. The present invention features a hinged trigger which has a mechanism for propelling and repelling the material in and out of the dispenser.

2. Prior Art Statement

Numerous ratcheting dispensers have been developed over the years and date back more than half a century. They have been developed for many purposes and have diverse mechanisms for operation. Additionally, various types of tubes and dispensers have been developed to advance cakes and pastes and bar materials such as underarm deodorant bars, lipstick bars, ski wax bars and the like.

U.S. Pat. No. 2,086,462 issued to David E. Bost describes a dispenser for discharging wax or other dispensing material by use of a vertical ratchet mechanism which has a squeeze trigger type handle member and various springs and mechanisms interconnected, including a clamping member and at least three pins or shafts and about six or seven separate pieces for the ratchet advancing mechanism.

U.S. Pat. No. 2,872,034 to W. H. Harris describes a lipstick container which has a typical twist to advance mechanism.

U.S. Pat. No. 3,221,409 issued to Charles J. Thiel and Louis J. Michaels describes an amalgam dispenser which, again, utilizes a trigger type mechanism with spring, pins and a complex arrangement of components.

U.S. Pat. No. 3,977,574 to Bradley Scott Thomas describes a dispensing pipette actuator system. This system also utilizes a ratcheting mechanism in a vertical direction but requires at least two springs and six or seven components for the ratchet driving mechanism.

U.S. Pat. No. 4,318,499 issued to Joel A. Hamilton, describes a propulsion apparatus with a self contained handle for use with a removable cartridge. This involved movement of hinged, semi-flexible ratcheting members as well as a plurality of springs and pins.

U.S. Pat. No. 4,323,176 describes a manually operable ratchet type dispenser for comestibles which includes a vertical ratcheting mechanism with a handle. This requires at least three pins and four or five complex components.

U.S. Pat. No. 5,320,259 issued to Weinstein and U.S. Pat. No. 5,372,285 issued to Harrold and Weinstein disclose ratchet systems for dispensing material, however, they do not include a reversible feature such as the present invention does to allow the user to propel and dispense the material when desired and after finishing repel the material, i.e. pull the material back into the confines of the dispenser.

Thus, notwithstanding the formidable prior art, there seems to be no teaching of the present invention which utilizes a single, semi-flexible component to perform the three functions: a trigger, a ratcheting member to advance a ratchet column and a return spring. Thus, separate from the advancing ratchet column itself, the present invention requires minimal moving parts, no metal springs and no or minimal set pins. The present invention utilizes a reversible trigger mechanism for propelling and retracting a material to be dispensed. The present invention may also utilize a staged vertical support column which provides for a reduced length of the vertical support column in its unextended position with respect to a fully extended length, thus allowing the device to contain considerably more material and less mechanism.

SUMMARY OF THE INVENTION

The present invention involves a dispenser. The dispenser includes a main hollow housing with side walls, a base and a top which is at least partially open for dispensing material therethrough. At least one vertical support column is included within the hollow housing and it has horizontal ratchets thereon as well as a push plate located at its top. A trigger component is also contained within the housing and it is formed of plastic material with at least one flexible portion therein. It acts as a trigger, a ratcheting member and a spring. It is strategically positioned in a hinged manner such that a retaining member holding the trigger component against one of the vertical support column ratchets may be rotated inwardly and released outwardly to cause the ratcheting mechanism either to advance the vertical support column or retract the vertical support column depending upon a selected trigger point. Thus, in an advancement mode, the trigger component has a first position and a second position wherein, when it is moved from the first position to the second position, it advances the vertical support column upwardly and when it is released and moves from its second position back to its first position, it retreats or aligns to the next lower ratchet on the vertical support column and is set for the next advance. In a retraction mode, the trigger component has a third position and a fourth position wherein, when it is moved from the third position to the fourth position, it retracts the vertical support column downwardly and when it is released, and moves from its fourth position back to its third position, it retreats or aligns to a next higher ratchet position.

BRIEF DESCRIPTION OF THE DRAWINGS

The present invention will be more fully understood when the disclosure set forth in the specification herein is taken in conjunction with the drawings appended hereto. Those drawings are.

DETAILED DESCRIPTION OF THE PRESENT INVENTION

The present invention is directed to a ratchet dispenser which is superior to the prior art dispensers due to its particular construction and design as well as its unique function. The improvement of the present invention device involves elimination of metal springs, pins and a significant plurality of components for ratcheting, thus substantially decreasing the likelihood of brakeage, simplifying construction and decreasing costs of manufacture. It is used to dispense solid and materials, in the form of cakes, bars and the like. It could also be used for gel-like materials. Throughout the detailed description, identical parts are identically numbered.

Figure 1:
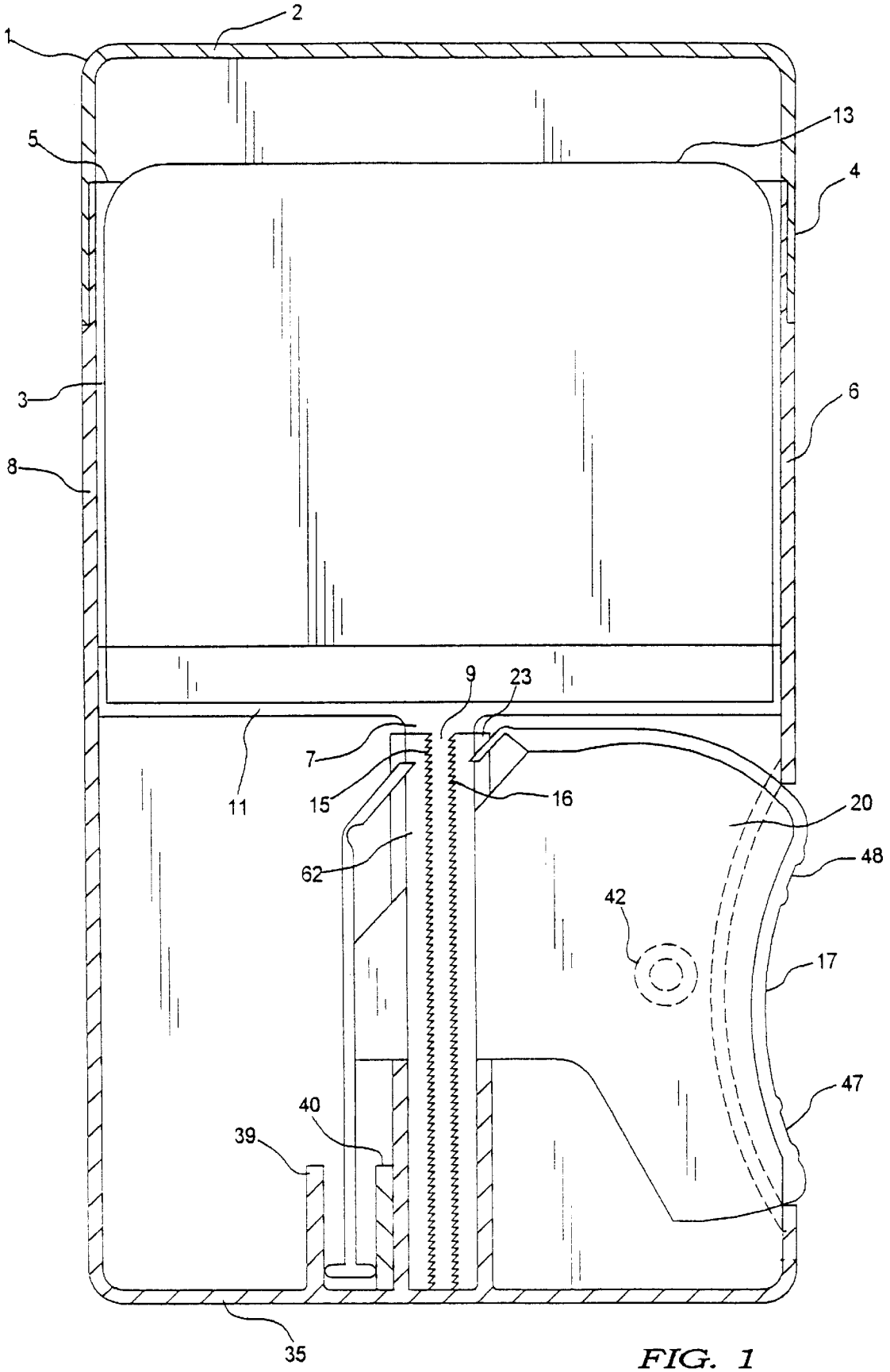
FIG. 1 shows a front cross sectional view of a present invention side action vertical ratchet dispenser.
Figure 2:
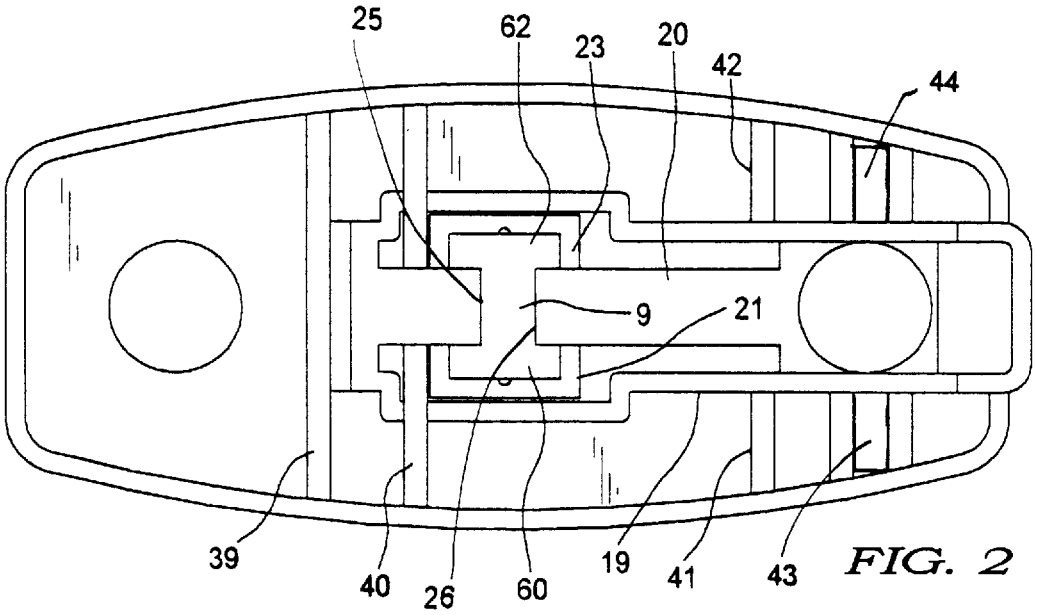
FIG. 2 shows a top cut view of the dispenser of the present invention device shown in FIG. 1.

Referring to FIGS. 1 and 2, there is shown a front cross sectional view and a top view of present invention dispenser 1. Dispenser 1 includes a main hollow housing 3, a trigger component 20 and a vertical support column 7.

Figure 3:
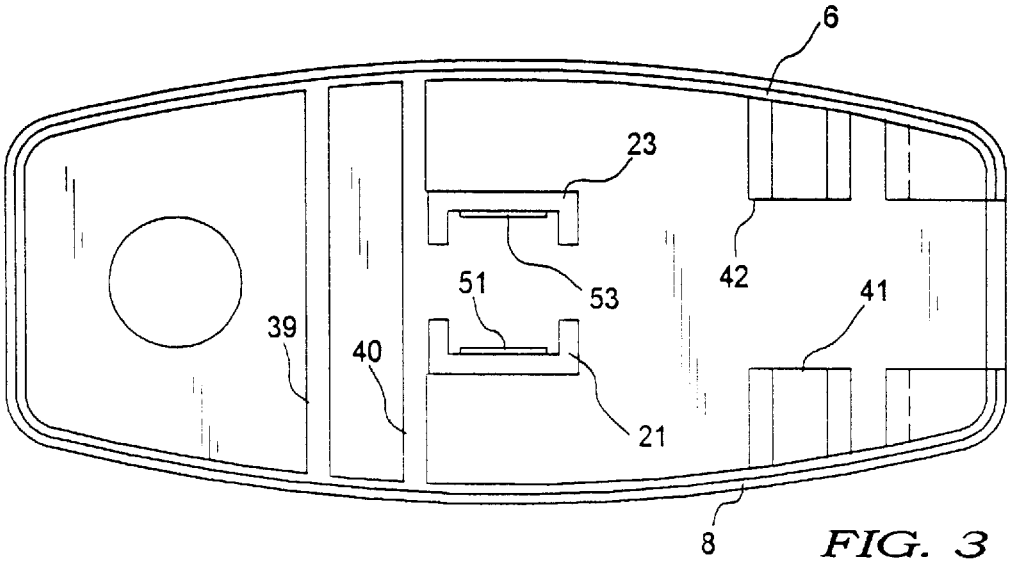
FIG. 3 shows a front cross sectional view of a base portion of the present invention side action vertical ratchet dispenser shown in FIGS. 1 and 2 of the present invention.
Figure 4:
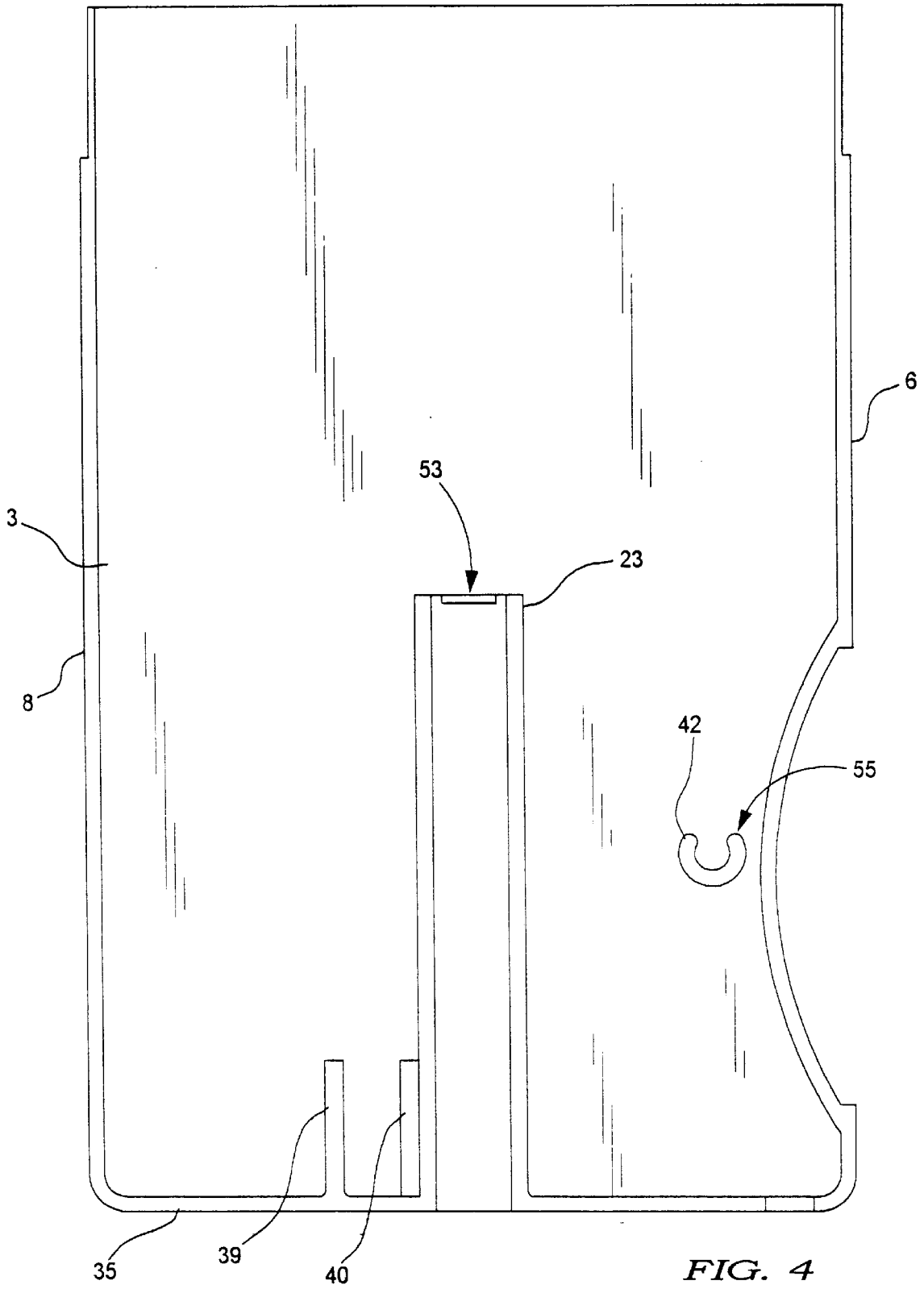
FIG. 4 shows a side view of the present invention dispenser shown in FIG. 3.
Figure 5:
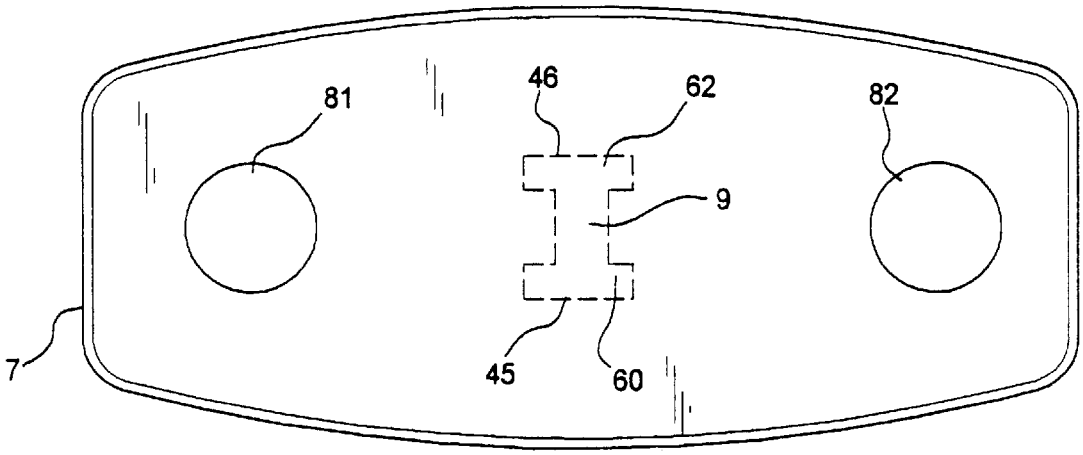
FIG. 5 shows a top view of the vertical support column with a push plate of the present invention.
Figure 6:
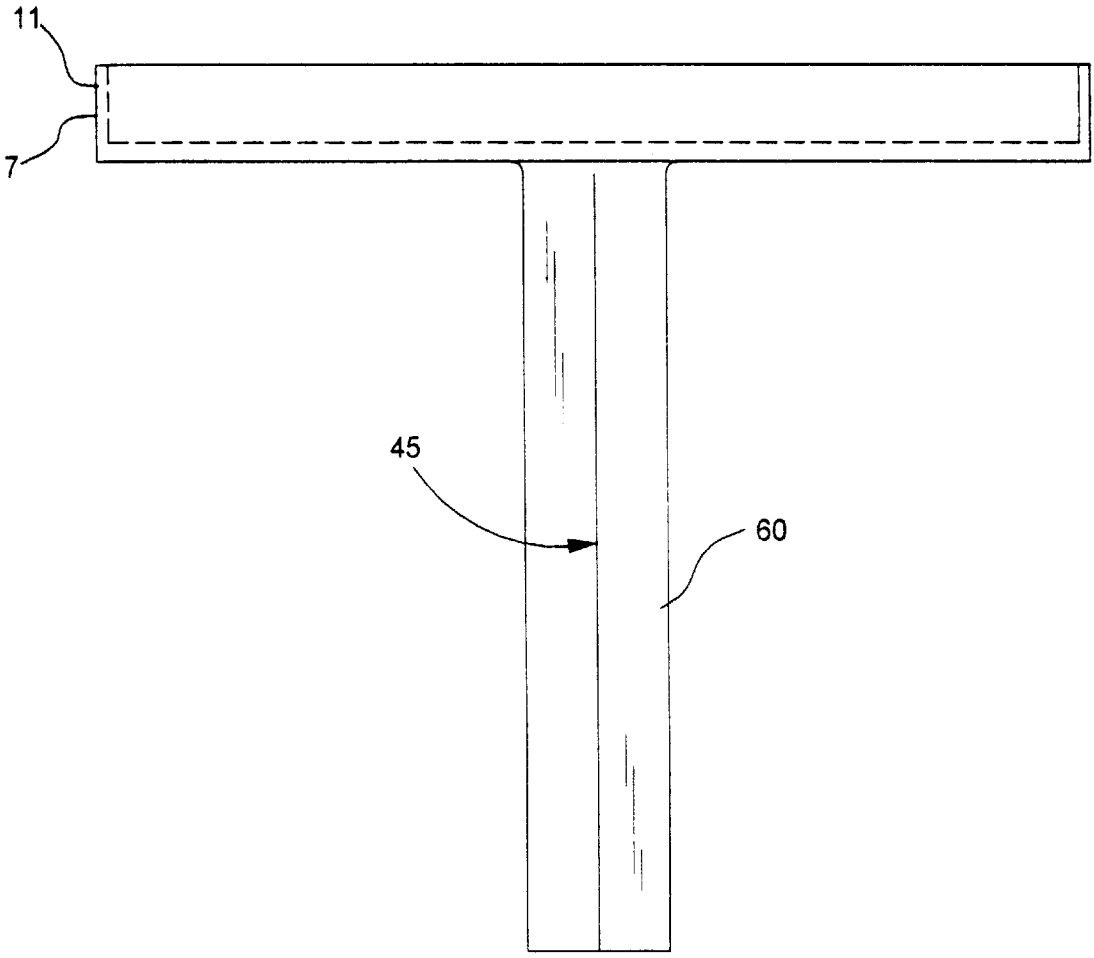
FIG. 6 illustrates a side view of the vertical support column shown in FIG. 5.
Figure 7:
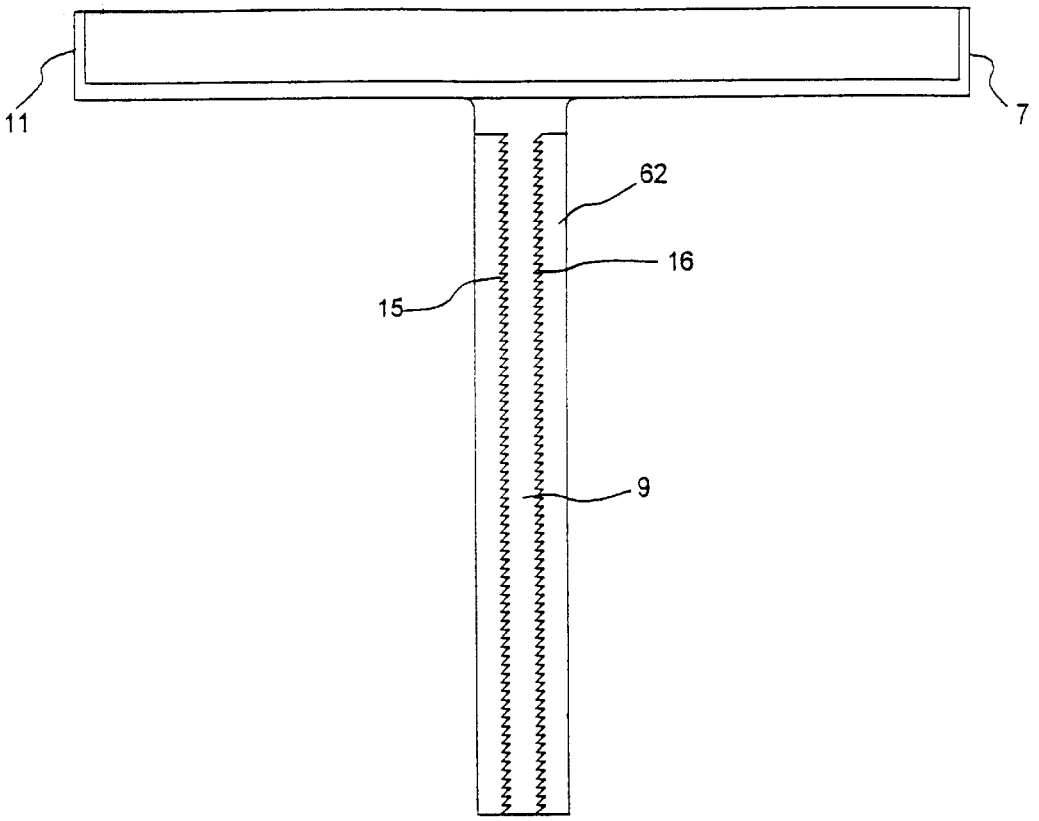
FIG. 7 illustrates a cross sectional side view of the vertical support column shown in FIG. 6.
Figure 8:
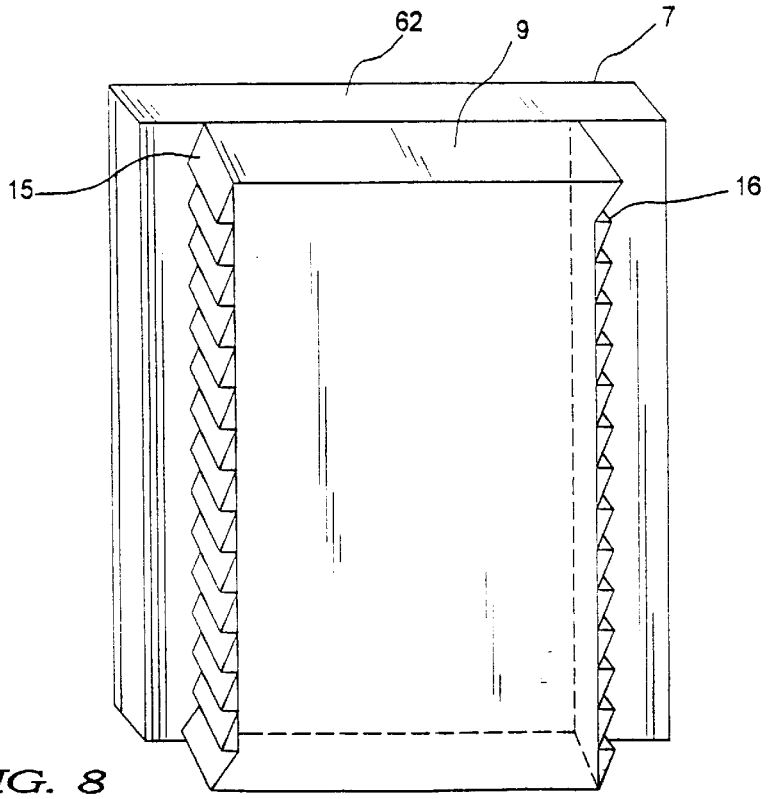
FIG. 8 shows a partial perspective view of the vertical support column shown in FIGS. 6 and 7.

Referring now also to FIGS. 3 and 4, main hollow housing 3 has side walls 6,8, a base 35, tension walls 39,40 and guide columns 21, 23. Guide columns 21, 23 each have an extended lip portion 51,53. Top 5 is fully open, as it has been developed for dispensing of stick materials such as deodorant stick 13. Extended wall portion 4 is adapted to receive lid 2, as shown. Main hollow housing 3 is further adapted with U-shaped pockets 41,42 for holding a trigger component 20. Referring now also to FIGS. 5–8, a vertical support column 7 includes a vertical ratchet track 9 with ratchets such as ratchet 15 and opposing ratchet 16, vertical side supports 60,62 and further includes and is connected to a push plate 11. Push plate 11 may have fill ports 81 and 82. Vertical side supports each have protrusions 45,46.

Figure 9:
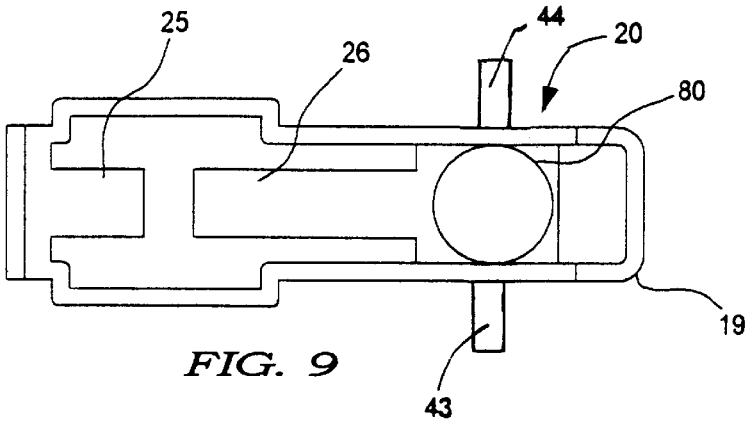
FIG. 9 shows a top view of a trigger mechanism of the present invention.
Figure 10:
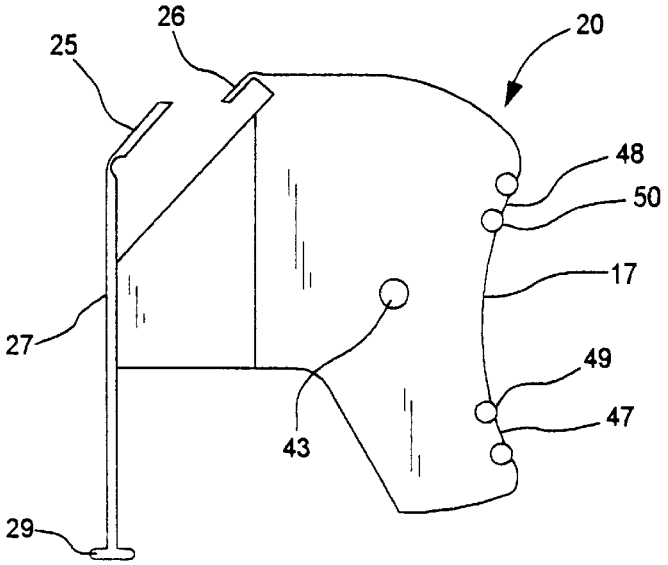
FIG. 10 illustrates a side view of the trigger mechanism shown in FIG. 9.
Figure 11:
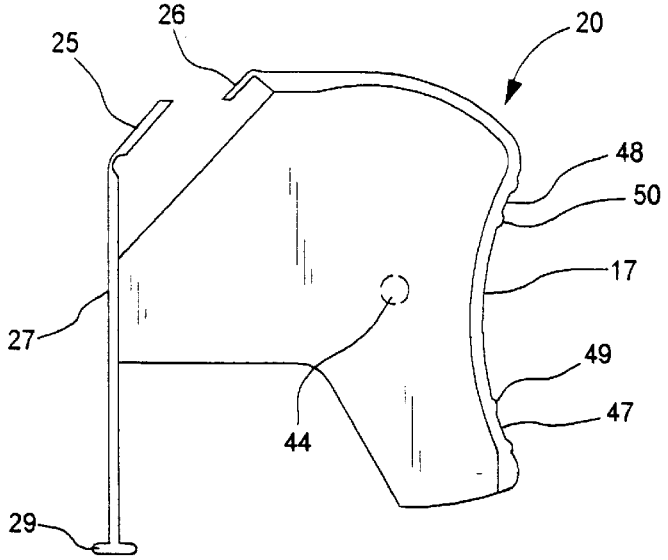
FIG. 11 illustrates a cross sectional of the trigger mechanism shown in FIG. 9.

Referring now to FIGS. 9–11, trigger component 20 has a frame 19. Frame 19 has a trigger lever 17 with an advancer activation area 47 and a retractor activation area 48. Advancer and retractor activation areas 47 and 48 may have indicia 49,50, respectively to aid in triggering dispenser 1. Frame 19 also has cylindrical protrusions or knobs 43,44 for fitting into U-shaped pockets 42,41 so as to be swingable or rotatable in and out of main hollow housing 3. An advancer arm 25 extends inwardly from one end of frame 19 and a retractor arm 26 extends inwardly from an opposite end and faces advancer arm 25. Alternatively, a fill port 80 may be situated at end opposite advancer arm 25, and retractor arm 26 would then extend inwardly from fill port 80. A spring portion 27 extends downwardly from advancer arm 25 and ends in a spring tensioner 29. Spring tensioner 29 is frictionally engaged within the cavity defined by tension walls 39,40.

Figure 12:
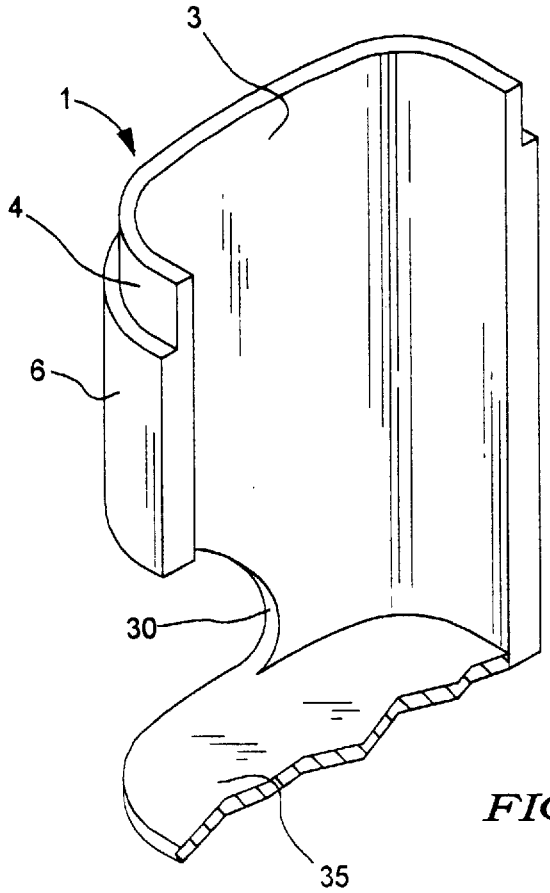
FIG. 12 illustrates the opening from which a user actuates a trigger component of the present invention.

Functionally, vertical support column 7 fits within and moves upwardly and downwardly in guide columns 21,23 as required by trigger component 20. Trigger component 20 acts as a trigger, as a ratcheting member and as a spring. As stated above, trigger component 20 is rotatably and swingably connected to main hollow housing 3 through an opening 30 (seen in FIG. 12 which only shows the trigger receiving opening and no other elements) by having cylindrical protrusions 43,44 rest in U-shaped pockets 41,42, respectively. A user advances or retracts deodorant stick 13 by pressing inwardly on trigger lever 17 at either advancer activation area 47 or retractor activation area 48. If activation area 47 is pressed, advancer arm 25 interacts with ratchet track 9 and specifically with ratchets 15 such that when advancer arm 25 is forced upwardly from a rest position (first position) to a second position, it moves vertical support column 7 up one ratchet length, thereby advancing push plate 11 and deodorant stick 13. The force used will overcome the frictional force developed between protrusions 45 and extended lip portion 51,53. However, the frictional force will help maintain the position of deodorant stick 13 upon application by user.

However, not only does trigger component 20 function as a trigger and a ratcheting advancer, but it also functions as a spring via spring portion 27 and spring tensioner 29. As force is applied to trigger lever 17, it causes a bending, stretching and tensioning of spring portion 27 and spring tensioner 29 (which is frictionally engaged within tension walls 39,40), such that when the force is not being applied, trigger lever 17 is automatically brought back to its rest position (first position) so that it and advancer arm 25 are reset for the next advance.

If the user wishes to retract deodorant stick 13 back into main hollow housing 3 after application thereof, trigger lever 17 is inwardly pressed at retractor activation area 48. As a result, retractor arm 26 interacts with ratchet track 9 and specifically with ratchets 16 such that when retractor arm 26 is forced downwardly, from a rest position (third position) to a fourth position, it moves vertical support column 7 down one ratchet length, thereby pulling push plate 11 and deodorant stick 13 back into main hollow housing 3. As before, the force used will overcome the frictional force developed between protrusions 45 and extended lip portion 51,53. Also as before, trigger lever 17 will return to its rest position upon removal of the application force via spring portion 27 and spring tensioner 29.

In preferred embodiments, as shown, the trigger component is unistructurally formed by being molded into one piece but may alternatively be an assemblage of two or more parts. However, there are significant manufacturing advantages achieved when unistructural molding is employed, including ease of manufacture, lower cost, fewer parts, less assemblage, less reject rate, etc.

As mentioned above, FIG. 12 shows a rear oblique view of a portion of present invention dispenser 1, i.e. housing 3, with identical parts being identically numbered. An opening 30 is shown for receiving trigger component 20. No other elements are shown in this view.

Obviously, numerous modifications and variations of the present invention are possible in light of the above teachings. It is therefore understood that within the scope of the appended claims, the invention may be practiced otherwise than as specifically described herein.

What is claimed is:

1. A dispenser, comprising:

(a) a main hollow housing having sidewalls, a base and a top which is at least partially open for dispensing material therethrough;

(b) a vertical support column having horizontal ratchets thereon, said vertical support column being vertically slidable mounted within said main hollow housing;

(c) a push plate located at a top of said vertical support column; and, (d) a trigger component movably connected to said main hollow housing and to the horizontal ratchets of said vertical support column, said trigger component having an advancer arm, a retractor arm situated opposite said advancer arm, and a flexible spring section extending generally vertically from said advancer arm and maintaining said trigger component in a rest position when said trigger component is not actuated, said trigger component being rotatably and recyclably movable between a first position and a second position such that when said trigger component is moved from said first position to said second position, it moves said vertical support column upwardly one ratchet length, and when said trigger component is moved from said second position to said first position, said advancer arm of said trigger component retreats to a next lower horizontal ratchet of said vertical support column, and said trigger component further being rotatably and recyclably movable between a third position and a fourth position such that when said trigger component is moved from said third position to said fourth position, it moves said vertical support column downwardly one ratchet length, and when said trigger component is moved from said fourth position to said third position, said retractor arm of said trigger component returns to a next upper horizontal ratchet of said vertical support column.

2. The dispenser of claim 1 wherein said top of said housing is open sufficiently to dispense a cake material and said push plate includes means for holding a portion of a cake material therein.

3. The dispenser of claim 2 wherein said sidewalls of said housing has a plurality of U-shaped pockets so as to receive and hold a corresponding plurality of cylindrical protrusions located on said trigger component.

4. The dispenser of claim 1 wherein said trigger component is unistructurally molded of one single, semi-flexible component.

5. The dispenser of claim 3 wherein said trigger component is unistructurally molded of one single, semi-flexible component.

6. The dispenser of claim 5 wherein said flexible spring section acts as a spring tensioned by a plurality of tension walls extending perpendicularly from said base of said housing.

7. The dispenser of claim 3, wherein said main hollow housing includes guide columns having extended lip portions for frictionally engaging a plurality of protrusions disposed on said vertical support column.

8. The dispenser of claim 7, wherein said trigger component has a trigger lever, said trigger lever having an advancer activation area for forcing said trigger component inwardly and upwardly to advance said vertical support column and a retractor activation area for forcing said trigger component inwardly and downwardly for pulling back said vertical support column.

9. The device of claim 8, wherein said advancer activation area and said retractor activation area each have a plurality of indicia for aid in triggering the dispenser.

10. The dispenser of claim 9 wherein said trigger component is unistructurally molded of one single, semi-flexible component.

11. A dispenser, comprising:

(a) a main hollow housing having sidewalls, a base and a top which is sufficiently open for dispensing material therethrough;

(b) a vertical support column having horizontal ratchets thereon, said vertical support column being vertically slidable mounted within said main hollow housing;

(c) a push plate located at a top of said vertical support column;

(d) means for movably connecting a trigger component to said main hollow housing and to said horizontal ratchets of said vertical support column; and (e) a trigger component having an advancer arm, a retractor arm situated opposite said advancer arm, and a flexible spring section extending generally vertically from said advancer arm and maintaining said trigger component in a rest position when said trigger component is not actuated, said trigger component being rotatably and recyclably movable between a first position and a second position such that when said trigger component is moved from said first position to said second position, it moves said vertical support column upwardly one ratchet length, and when said trigger component is moved from said second position to said first position, said advancer arm of said trigger component retreats to a next lower horizontal ratchet of said vertical support column, and said trigger component further being rotatably and recyclably movable between a third position and a fourth position such that when said trigger component is moved from said third position to said fourth position, it moves said vertical support column downwardly one ratchet length, and when said trigger component is moved from said fourth position to said third position, said retractor arm of said trigger component returns to a next upper horizontal ratchet of said vertical support column.

12. The dispenser of claim 11 wherein said top which is sufficiently open for dispensing material therethrough dispenses a cake material and said push plate includes means for holding a portion of a cake material therein.

13. The dispenser of claim 12, wherein said means for movably connecting includes a plurality of U-shaped pockets on said sidewalls of said main hollow housing which receive and hold a corresponding plurality of cylindrical protrusions located on said trigger component.

14. The dispenser of claim 13, wherein said main hollow housing includes guide columns having extended lip portions which frictionally engage a plurality of protrusions disposed on said vertical support column.

15. The dispenser of claim 14, wherein said trigger component has a trigger lever, said trigger lever having an advancer activation area for forcing said trigger component inwardly and upwardly to advance said vertical support column and a retractor activation area for forcing said trigger component inwardly and downwardly for pulling back said vertical support column.

16. The dispenser of claim 15 wherein said flexible spring section acts as a spring tensioned by a plurality of tension walls extending perpendicularly from said base of said housing.

17. The dispenser of claim 16 wherein said trigger component is unistructurally molded of one single, semi-flexible component.

18. The dispenser of claim 11, wherein said main hollow housing includes guide columns having extended lip portions which frictionally engage a plurality of protrusions disposed on said vertical support column.

19. The dispenser of claim 11, wherein said trigger component has a trigger lever, said trigger lever having an advancer activation area for forcing said trigger component inwardly and upwardly to advance said vertical support column and a retractor activation area for forcing said trigger component inwardly and downwardly for pulling back said vertical support column.

20. The dispenser of claim 11 wherein said trigger component is unistructurally molded of one single, semi-flexible component.

* * * * *